US011120758B2

(12) United States Patent
Jo et al.

(10) Patent No.: US 11,120,758 B2
(45) Date of Patent: Sep. 14, 2021

(54) DISPLAY APPARATUS AND CONTROL METHOD THEREOF

(71) Applicant: SAMSUNG ELECTRONICS CO., LTD., Suwon-si (KR)

(72) Inventors: Younghun Jo, Suwon-si (KR); Huijung Lee, Suwon-si (KR); Gangmo Koo, Suwon-si (KR); Shinhaeng Kim, Suwon-si (KR); Wonseok Song, Suwon-si (KR); Yoosun Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/831,006

(22) Filed: Mar. 26, 2020

(65) Prior Publication Data

US 2021/0150997 A1 May 20, 2021

(30) Foreign Application Priority Data

Nov. 19, 2019 (KR) ..... 10-2019-0148785

(51) Int. Cl.
*G09G 3/34* (2006.01)
*G09G 3/36* (2006.01)

(52) U.S. Cl.
CPC ..... *G09G 3/3648* (2013.01); *G09G 3/3607* (2013.01); *G09G 2320/0233* (2013.01);
(Continued)

(58) Field of Classification Search
CPC ..... G09G 3/34–3426
See application file for complete search history.

(56) References Cited

U.S. PATENT DOCUMENTS 8,334,930 B2 12/2012 Kim et al.
8,427,418 B2 4/2013 Cho et al.
(Continued)

FOREIGN PATENT DOCUMENTS

JP 5743242 B2 7/2015
KR 10-2008-0072389 8/2008
(Continued)

OTHER PUBLICATIONS

International Search Report dated Oct. 15, 2020 for PCT/KR2020/009198; 3pgs.
(Continued)

*Primary Examiner* — Roy P Rabindranath
(74) *Attorney, Agent, or Firm* — Nixon & Vanderhye P.C.

(57) ABSTRACT

A display apparatus is provided. The display apparatus includes a display panel including a plurality of pixels and configured to display an image corresponding to an image signal, a backlight including a plurality of light sources, and configured to independently operate a light emitting block corresponding to each of the plurality of light sources to provide light to the display panel, and a processor configured to control an amount of light of each of the plurality of light sources according to the image signal. The processor is configured to calculate an amount of a red (R) light, an amount of a green (G) light, and an amount of a blue (B) light that at least one light source among the plurality of light sources is configured to emit to one area on the display panel, identify the color information of the one area based on each of the calculated amounts of the R light, the G light, and the B light, and adjust an image signal corresponding to the one area based on the identified color information.

19 Claims, 12 Drawing Sheets

(52) U.S. Cl.
CPC ..... *G09G 2320/0242* (2013.01); *G09G 2320/0626* (2013.01)

(56) References Cited

U.S. PATENT DOCUMENTS

| | | | | |
|---|---|---|---|---|
| 8,629,831 | B2 | 1/2014 | Park et al. | |
| 10,147,345 | B2 | 12/2018 | Choi et al. | |
| 2008/0002103 | A1 | 1/2008 | Lee | |
| 2010/0156927 | A1 | 6/2010 | Takase | |
| 2012/0313979 | A1* | 12/2012 | Matsuura | G09G 3/3413 345/690 |
| 2016/0210912 | A1 | 7/2016 | Tada | |
| 2017/0084250 | A1* | 3/2017 | Jia | G01J 3/10 |
| 2018/0149322 | A1 | 5/2018 | Tada | |
| 2018/0157121 | A1 | 6/2018 | Matsuura et al. | |

FOREIGN PATENT DOCUMENTS

| | | | |
|---|---|---|---|
| KR | 10-2009-0041695 | | 4/2009 |
| KR | 10-2015-0137722 | | 12/2015 |
| KR | 10-1965723 | B1 | 4/2019 |

OTHER PUBLICATIONS

International PCT Written Opinion dated Oct. 15, 2020 for PCT/KR2020/009198; 6pgs.
European Office Action dated Feb. 18, 2021 for EP Application No. 20166173.3.

* cited by examiner

DISPLAY APPARATUS AND CONTROL METHOD THEREOF

CROSS-REFERENCE TO RELATED APPLICATION

This application is based on and claims priority under 35 U.S.C. § 119 to Korean patent application number 10-2019-0148785, filed on Nov. 19, 2019 in the Korean Intellectual Property Office, the disclosure of which is incorporated by reference herein in its entirety.

BACKGROUND

1. Field

The disclosure relates to a display apparatus and a control method thereof, and for example, to a display apparatus using a plurality of light sources, and a control method thereof.

2. Description of Related Art

Spurred by the development of electronic technologies, various types of electronic apparatuses are being developed and distributed. In particular, display apparatuses such as mobile apparatuses and TVs that are being used the most recently have been developed rapidly in a recent few years.

A conventional display apparatus outputs an image signal by implementing local dimming for enhancing a dynamic range and a contrast ratio. Meanwhile, there was a problem that in controlling local dimming, lights were provided disproportionately to a panel, and a yellowing phenomenon wherein the ratio of a green light or a red light became high in one area of the panel occurred.

Also, there was a problem that an unintended yellowing phenomenon provided a screen including distorted colors to a user when a display apparatus output an image signal.

SUMMARY

Embodiments of the disclosure provide a display apparatus preventing and/or reducing a yellowing phenomenon that may occur in one area of a panel in controlling local dimming, and a control method thereof.

An image processing apparatus according to an example embodiment of the disclosure includes: a display panel including a plurality of pixels and configured to display an image based on an image signal, a backlight including a plurality of light sources, and configured to independently operate a light emitting block corresponding to each of the plurality of light sources to provide light to the display panel, and a processor configured to control an amount of light of each of the plurality of light sources based on the image signal. The processor is configured to calculate (e.g., determine or identify) an amount of a red (R) light, an amount of a green (G) light, and an amount of a blue (B) light that at least one light source among the plurality of light sources are configured to emit to one area on the display panel, identify the color information of the one area based on each of the calculated (e.g., determined or identified) amounts of the R light, the G light, and the B light, and to adjust an image signal corresponding to the one area based on the identified color information.

The processor may calculate (e.g., determine or identify) each of the R amount of light, the G amount of light, and the B amount of light emitted to the one area based on the distance between the at least one light source and the one area and a strength of the at least one light source.

The processor may identify the color information of the one area based on a sum of an amount of a red (R) light, an amount of a green (G) light, and an amount of a blue (B) light that a first light source among the plurality of light sources is configured to emit to the one area and an amount of a red (R) light, an amount of a green (G) light, and an amount of a blue (B) light that a second light source among the plurality of light sources is configured to emit to the one area.

The processor may identify the color information based on conversion of each of the calculated amounts of the R light, the G light, and the B light to a color coordinate.

The color information may include a color temperature.

The one area may be an area corresponding to at least one light emitting block among the plurality of light emitting blocks or an area corresponding to at least one among the plurality of pixels on the display panel.

The processor may adjust a ratio among a red (R) signal, a green (G) signal, and a blue (B) signal of an image signal corresponding to the one area based on the identified color information.

The processor may, based on a color temperature of the identified color information being higher than or equal to a threshold temperature, be configured to adjust the ratio among the R signal, the G signal, and the B signal such that a strength of the B signal is relatively increased compared to a strength of the R signal and a strength of the G signal. The processor may, based on a color temperature of the identified color information being lower than a threshold temperature, be configured to adjust the ratio among the R signal, the G signal, and the B signal such that the strength of the B signal is relatively decreased compared to the strength of the R signal and the strength of the G signal.

The display apparatus may further include a memory storing information on the ratio of the strength of RGB image signals for each color information, and the processor may be configured to adjust the ratio among the R signal, the G signal, and the B signal of an image signal corresponding to the one area based on the information stored in the memory and the identified color information.

The display apparatus may further include a memory including information on the amount of light of each of the RGB based on the distance between the at least one light source among the plurality of light sources and the display panel. The processor may calculate the amount of the red (R) light, the amount of the green (G) light, and the amount of the blue (B) light based on the distance between the at least one light source and the one area based on the information on the amount of light stored in the memory.

The backlight may further include a light sheet separately arranged in an upper part of the plurality of light sources. The information on the amount of light may be information calculated based on a first amount of light emitted from the at least one light source and reaching an area of the light sheet and a second amount of light emitted from the at least one light source and reflected on the light sheet and reaching an area of the light sheet.

In the display apparatus, the backlight may include a light sheet, and each of the plurality of light sources may comprise a blue LED, and the light sheet may comprise a quantum dot sheet.

A method of controlling a display apparatus including a backlight including a plurality of light sources, and configured to independently operate a light emitting block corresponding to each of the plurality of light sources to provide lights to a display panel according to an example embodiment of the disclosure comprises: calculating (e.g., determining) an amount of a red (R) light, an amount of a green (G) light, and an amount of a blue (B) light that at least one light source among the plurality of light sources is configured to emit to one area on the display panel, identifying the color information of the one area based on each of the calculated (e.g., determined or identified) amounts of the R light, the G light, and the B light, and adjusting an image signal of the one area based on the identified color information.

The identifying the color information may include identifying the color information of the one area based on a sum of an amount of a red (R) light, an amount of a green (G) light, and an amount of a blue (B) light that a first light source among the plurality of light sources is configured to emit to the one area and an amount of a red (R) light, an amount of a green (G) light, and an amount of a blue (B) light that a second light source among the plurality of light sources is configured to emit to the one area.

The identifying the color information may include identifying the color information based on conversion of each of the calculated amounts of the R light, the G light, and the B light to a color coordinate.

The color information may include a color temperature.

The one area may be an area corresponding to at least one light emitting block among the plurality of light emitting blocks or an area corresponding to at least one among the plurality of pixels on the display panel.

The adjusting an image signal may include adjusting a ratio among a red (R) signal, a green (G) signal, and a blue (B) signal of an image signal corresponding to the one area based on the identified color information.

The adjusting an image signal may include, based on a color temperature of the identified color information being higher than or equal to a threshold temperature, adjusting a ratio among the R signal, the G signal, and the B signal such that a strength of the B signal is relatively increased compared to a strength of the R signal and a strength of the G signal, and based on a color temperature of the identified color information being lower than a threshold temperature, adjusting the ratio among the R signal, the G signal, and the B signal such that the strength of the B signal is relatively decreased compared to the strength of the R signal and the G signal.

The adjusting an image signal may include reading the ratio of the strength of RGB image signals corresponding to the identified color information from a memory storing information on the ratio of the strength of RGB image signals for each color information and adjusting the ratio among the R signal, the G signal, and the B signal of an image signal corresponding to the one area.

According to various example embodiments of the disclosure, in displaying an image signal using a plurality of light sources, local dimming can be effectively implemented.

According to various example embodiments of the disclosure, a case wherein, in controlling local dimming, light emitted from light sources are provided disproportionately to one area of a display panel can be predicted.

In addition, according to various example embodiments of the disclosure, a color distortion phenomenon and a yellowing phenomenon that occur as lights are provided disproportionately to one area of a display panel can be predicted, and an image signal can be output while being adjusted such that an unintended yellowing phenomenon does not occur and/or is reduced in the one area.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
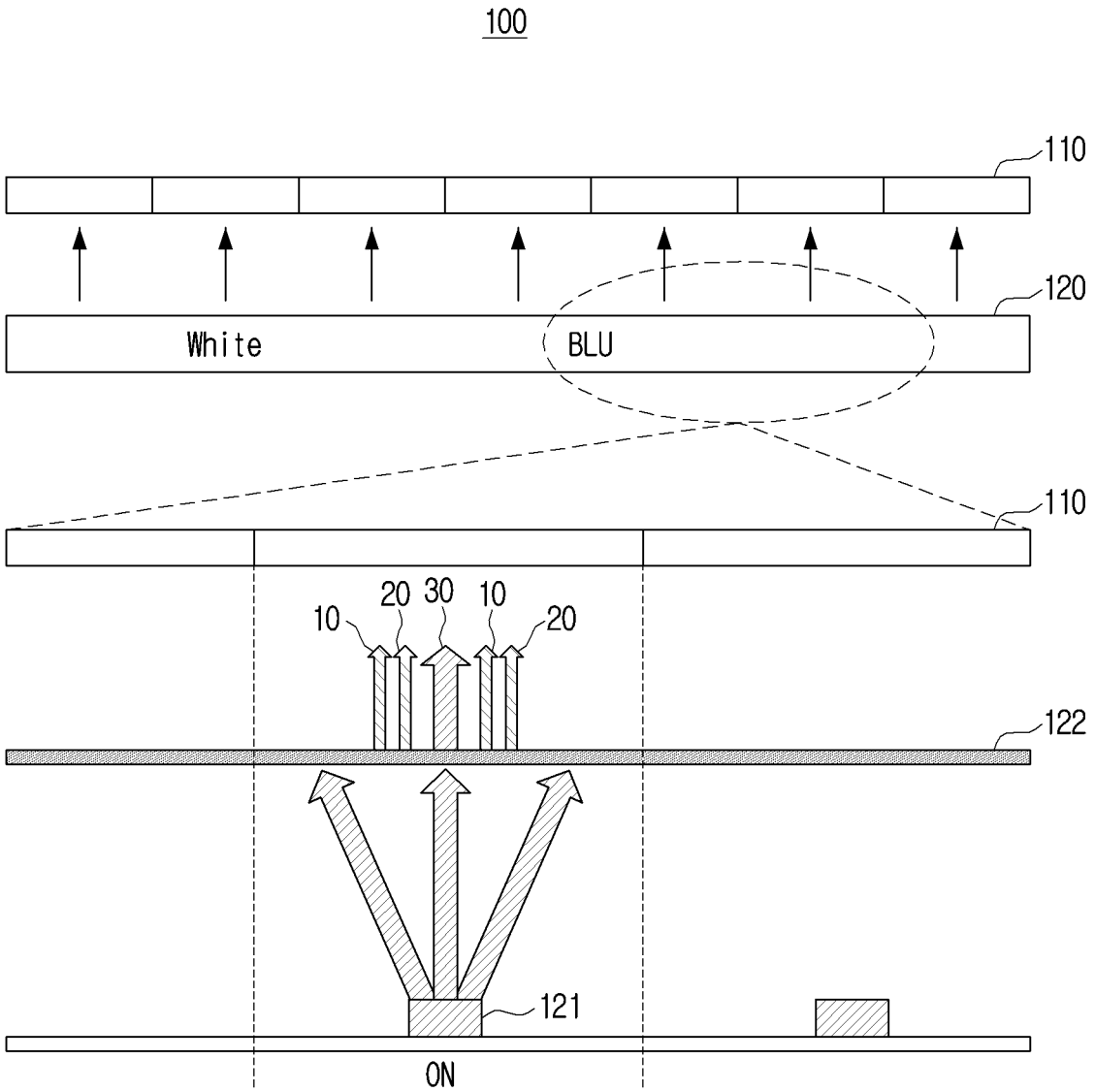
FIG. 1 is a diagram illustrating an example configuration of an example backlight according to an embodiment of the disclosure.

Hereinafter, the disclosure will be described in greater detail with reference to the accompanying drawings.

As terms used in the embodiments of the disclosure, general terms that are currently used widely were selected as far as possible, in consideration of the functions described in the disclosure. However, the terms may vary depending on the intention of those skilled in the art who work in the pertinent field, previous court decisions, or emergence of new technologies. Also, in particular cases, certain terms may be arbitrarily selected, and in such cases, the meaning of the terms will be described in the relevant descriptions in the disclosure. Thus, the terms used in the disclosure should be defined based on the meaning of the terms and the overall content of the disclosure, but not just based on the names of the terms.

In this disclosure, expressions such as "have," "may have," "include" and "may include" should be understood as denoting that there are such characteristics (e.g., elements such as numerical values, functions, operations and components), and the expressions are not intended to exclude the existence of additional characteristics.

The expression "at least one of A and B" should be interpreted to include any one of "A" or "B" or "A and B."

The expressions "first," "second" and the like used in this disclosure may be used to describe various elements regardless of any order and/or degree of importance. Also, such expressions may be used to distinguish one element from another element, and are not intended to limit the elements.

The description in the disclosure that one element (e.g.: a first element) is "(operatively or communicatively) coupled with/to" or "connected to" another element (e.g., a second element) should be interpreted to include both the case where the one element is directly coupled to the another element, and the case where the one element is coupled to the another element through still another element (e.g., a third element).

Singular expressions also include plural expressions as long as they do not clearly conflict with the context. In addition, in the disclosure, terms such as "include" and "consist of" should be understood as designating that there are such characteristics, numbers, steps, operations, elements, components or a combination thereof described in the disclosure, but not to exclude in advance the existence or possibility of adding one or more of other characteristics, numbers, steps, operations, elements, components or a combination thereof.

In the disclosure, "a module" or "a part" may perform at least one function or operation, and may be implemented as hardware or software, or as a combination of hardware and software. Further, a plurality of "modules" or "parts" may be integrated into at least one module and implemented as at least one processor (not shown), excluding "a module" or "a part" that needs to be implemented as specific hardware.

In this disclosure, the term "user" may refer to a person who uses an electronic apparatus or an apparatus using an electronic apparatus (e.g.: an artificial intelligence electronic apparatus).

Hereinafter, various example embodiments of the disclosure will be described in greater detail with reference to the accompanying drawings.

FIG. 1 is a diagram illustrating an example implementation of an example backlight according to an embodiment of the disclosure.

According to what is illustrated in FIG. 1, the display apparatus 100 according to an embodiment of the disclosure may include a display panel 110 and a backlight unit (e.g., a backlight) 120.

The display apparatus 100 may display video data. The display apparatus 100 may be implemented as a TV, but is not limited thereto, and any apparatus equipped with a display function such as, for example, and without limitation, a video wall, a large format display (LFD), digital signage, a digital information display (DID), a projector display, etc. can be applied without limitation. The display apparatus 100 may be implemented as displays in various forms such as, for example, and without limitation, a liquid crystal display (LCD), an organic light-emitting diode (OLED), liquid crystal on silicon (LCoS), digital light processing (DLP), a quantum dot (QD) display panel, quantum dot light-emitting diodes (QLED), micro light-emitting diodes (μLED), mini LED, etc. The display apparatus 100 may be implemented, for example, and without limitation, as a touch screen combined with a touch sensor, a flexible display, a rollable display, a 3D display, a display to which a plurality of display modules are physically connected, etc.

The display panel 110 according to an embodiment of the disclosure may include a plurality of pixels and display an image signal. As an example, the display panel 110 may be implemented as a liquid crystal display panel, but is not limited thereto. A liquid crystal panel is a display panel implemented as a liquid crystal device which is a display device using liquid crystals that can electronically control transmittance of lights.

According to an embodiment of the disclosure, the display panel 110 may operate by a method wherein liquid crystals are injected between two glass plates, and the injected liquid crystals make a light provided from the backlight unit 120 pass through in a vertical alignment and a horizontal distorted alignment through ON/OFF of a thin film transistor, and the light is scanned on the front surface of the display panel 110.

A liquid crystal panel is implemented as a liquid crystal device that does not emit light by itself, and accordingly, in order for a liquid crystal panel to implement an image, the display apparatus 100 should include a backlight unit 120. The backlight unit 120 plays the role of shedding lights evenly so that a display image is visible to eyes. The terms backlight and backlight unit may be used interchangeably herein to denote the components included to provide a backlight to the display.

The backlight unit 120 according to an embodiment of the disclosure may include a plurality of light sources 121, a light guide plate (not shown), and a light sheet 122.

When power is supplied, the backlight unit 120 may emit a light of a single color (e.g., a light of a specific wavelength). For example, the backlight unit 120 according to an embodiment of the disclosure may emit a white light.

The plurality of light sources 121 provided on the backlight unit 120 according to an embodiment of the disclosure may be implemented as blue light emitting diodes (blue LEDs) for high color reproducibility. The light sheet 122 may be implemented as a quantum dot (QD) sheet. A quantum dot sheet may generate various colors by converting the wavelengths of lights emitted from the plurality of light sources 121 according to the sizes of particles. For example, the light sheet 122 may generate a red (R) light and a green (G) light by converting some wavelengths of the blue (B) lights emitted from the light sources 121. As the light sheet 122 converts wavelengths of lights, it may be referred to as a wavelength conversion unit, but for the convenience of explanation, it may be referred to as the light sheet 122.

Referring to FIG. 1, as some of the blue (B) light emitted from the light sources 121 may be converted into red (R) light 10 and green (G) light 20 by the light sheet 122 and pass through the light sheet 122, white light having high purity may be provided to an area of the display panel 110 by the red (R) light 10, the green (G) light 20, and the blue (B) light 30 passing through the light sheet 122.

In the disclosure, for the convenience of explanation, a case wherein the plurality of light sources 121 included in the backlight unit 120 are implemented as blue LEDs, and the light sheet 122 is implemented as a quantum dot (QD) sheet was assumed, but the disclosure is not limited thereto.

For example, the backlight unit 120 may include, for example, and without limitation, cold cathode fluorescence lamps (CCFLs), white light emitting diodes (white LEDs), or the like, having little heating values as the plurality of light sources 121. The backlight unit 110 may independently operate the plurality of light sources 121 and provide light to the display panel 110.

The backlight unit 110 according to an embodiment of the disclosure may independently operate the plurality of light sources 121 and implement local dimming corresponding to an image signal. Hereinafter, various example embodiments wherein the display apparatus 100 implements local dimming corresponding to an image signal based on the amount of light of each of the red (R) light 10, the green (G) light 20, and the blue (B) light 30 provided to the display panel 110 will be explained in greater detail.

Figure 2:
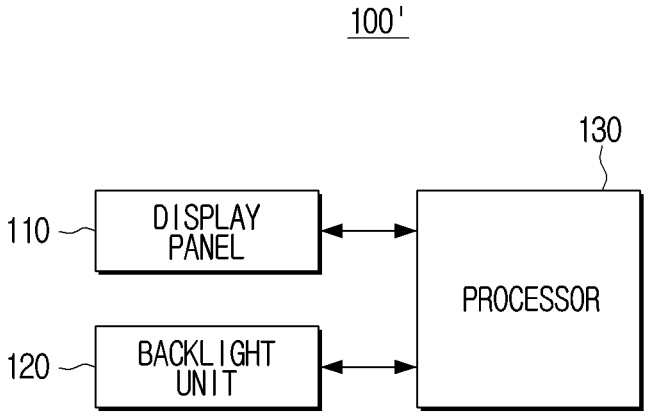
FIG. 2 is a block diagram illustrating an example configuration of an example display apparatus according to an embodiment of the disclosure.

FIG. 2 is a block diagram illustrating an example configuration of an example display apparatus according to an embodiment of the disclosure.

Referring to FIG. 2, the display apparatus 100 may include a display panel 110, a backlight unit (e.g., a backlight) 120, and a processor (e.g., including processing circuitry) 130. Among the components illustrated in FIG. 2, regarding the components overlapping with the components illustrated in FIG. 1, detailed explanation may not be repeated here.

The display panel 110 may include a plurality of pixels, and control the brightness of each of the plurality of pixels using liquid crystals. As an example, in the case of displaying a relatively dark image based on an image signal, the display panel 110 may display an image of low luminance by blocking several lights among the lights provided from the backlight unit 120 by liquid crystals. As another example, in the case of displaying a relatively bright image based on an image signal, the display panel 110 may display an image of high luminance by making several lights among the lights provided from the backlight unit 120 pass through by liquid crystals.

Due to the difficulty of the liquid crystals of the display panel 110 to block all lights emitted from the light sources 121, in order for expressing an image of low luminance more appropriately and expanding a dynamic range, and improving a contrast ratio, the backlight unit 120 may implement local dimming by independently operating the plurality of light sources 121 under control of the processor 130.

The backlight unit 120 may be divided into a plurality of light emitting blocks, and each of the plurality of light emitting blocks may include at least one light source 121. According to an embodiment of the disclosure, each of the plurality of light emitting blocks may be in a corresponding relation with different areas of the display panel 110. A more detailed explanation in this regard will be made with reference to FIG. 3.

Figure 3:
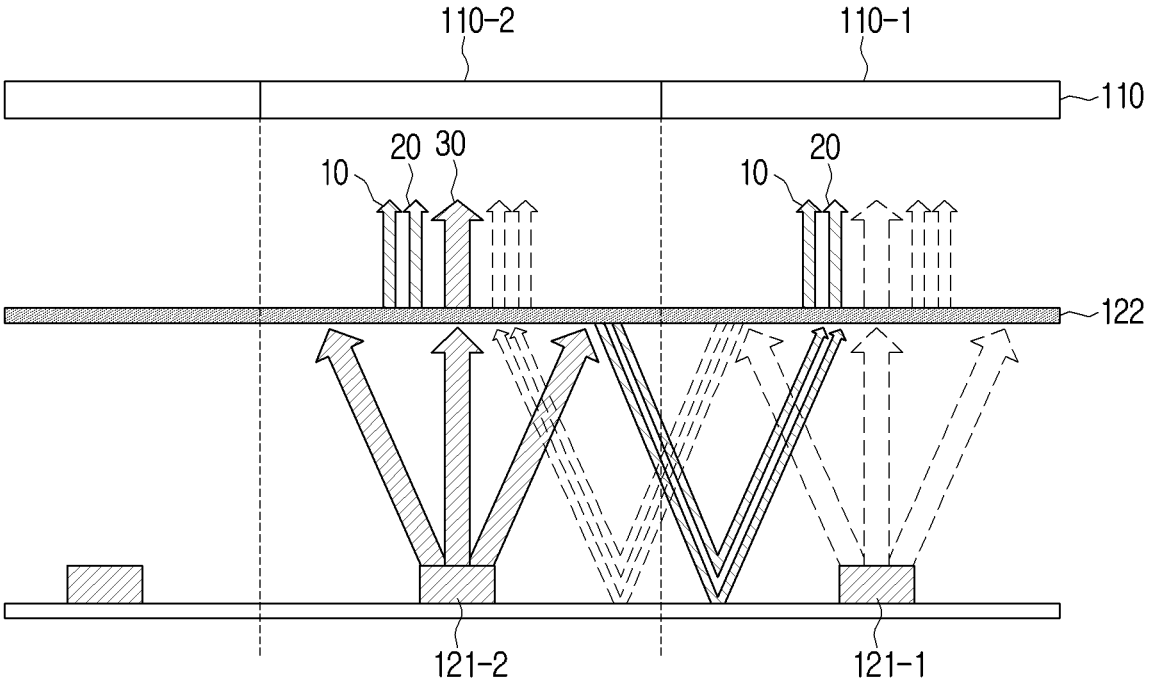
FIG. 3 is a diagram illustrating an example of a plurality of light sources according to an embodiment of the disclosure.

FIG. 3 is a diagram illustrating an example of a plurality of light sources according to an embodiment of the disclosure.

According to an embodiment of the disclosure, the backlight unit 120 may be implemented as a direct type backlight unit. For example, a direct type backlight unit may be implemented as a structure wherein a plurality of optical sheets and a diffusion plate are laminated in the lower part of the display panel 110 and a plurality of light sources are arranged in the lower part of the diffusion plate.

In the case of a direct type backlight unit, it may be divided into a plurality of light emitting blocks as illustrated, for example, in FIG. 3 based on the arrangement structure of a plurality of light sources. In this case, each of the plurality of light emitting blocks may be respectively operated according to the current duty based on image information of a corresponding screen area.

Referring to FIG. 3, the backlight unit 120 may be divided into a plurality of light emitting blocks, and each of the plurality of light emitting blocks may include at least one light source 121. According to an embodiment of the disclosure, a first light emitting block including a first light source 121-1 among the plurality of light sources 121 may be in a corresponding relation with a first area 110-1 of the display panel 110. A corresponding relation may refer, for example, to a light emitted from the first light source 121-1 included in the first light emitting block being provided to the first area 110-1 of the display panel 110.

As another example, a second light emitting block including a second light source 121-2 among the plurality of light sources 121 may be in a corresponding relation with a second area 110-2 of the display panel 110. Accordingly, the light emitted by the second light source 121-2 included in the second light emitting block may be provided to the second area 110-2.

For example, if the light sources 121 are implemented as blue LEDs and the light sheet 122 is implemented as a quantum dot sheet, some of the blue (B) light emitted by the second light source 121-2 may be changed to the red (R) light 10 and the green (G) light 20 by the light sheet 122 and pass through the light sheet 122, and the other light may pass through the light sheet 122 as the blue (B) light 30. White light according to the red (R) light 10, the green (G) light 20, and the blue (B) light 30 may be provided to the second area 110-2 corresponding to the second light source 121-2.

The amount of the blue (B) light emitted by the second light source 121-2 and the amount of white light provided to the second area 110-2 corresponding to the second light source 121-2 on the display panel 110 may be different. For example, all of the blue (B) light emitted by the second light source 121-2 may not pass through the light sheet 122 on the second light emitting block, but may be reflected or diffused to another light emitting block.

Referring to FIG. 3, some of the blue (B) light emitted by the second light source 121-2 may be converted into the red (R) light and the green (G) light by the light sheet 122, and some of the converted red (R) light and green (G) light may pass through the light sheet 122, and the other light may be reflected by the light sheet 122 and diffused to another light emitting block. For example, some of the blue (B) light emitted by the second light source 121-2 may be converted into the red (R) light and the green (G) light by the light sheet 122, and then reflected by the light sheet 122 and diffused to the first light emitting block. The first light emitting block may be a light emitting block adjacent to the second light emitting block.

The red (R) light and the green (G) light diffused to the first light emitting block may pass through the light sheet 122 and may be provided to the first area 110-1 on the display panel 110. If light emitted from the light sources 121 are reflected by the light sheet 122 and diffused to another light emitting block, the red (R) light and the green (G) light reflected by the light sheet 122 may be provided to an area corresponding to the another light emitting block on the display panel 110. Accordingly, a color that is not intended, e.g., a color that does not correspond to an image signal may be expressed in the one area.

Hereinafter, various example embodiments wherein the display apparatus 100 calculates (e.g., determines or identifies) the amounts of the red (R) light, the green (G) light, and the blue (B) light emitted to one area, and adjusts an image signal corresponding to the one area based on the calculated amounts of lights will be explained in greater detail.

Returning to FIG. 2, the processor 130 may include various processing circuitry and controls the overall operations of the display apparatus 100.

According to an embodiment of the disclosure, the processor 130 may be implemented, for example, and without limitation, as a digital signal processor (DSP) processing digital image signals, a microprocessor, an artificial intelligence (AI) processor, a timing controller (T-CON), or the like. However, the disclosure is not limited thereto, and the processor 130 may include, for example, and without limitation, one or more of a central processing unit (CPU), a dedicated processor, a micro controller unit (MCU), a micro processing unit (MPU), a controller, an application processor (AP), a communication processor (CP), an ARM processor, or the like, or may be defined by the terms. The processor 130 may be implemented as a system on chip (SoC) having a processing algorithm stored therein or large scale integration (LSI), or in the form of a field programmable gate array (FPGA).

The processor 130 may operate the backlight unit 120 to provide light to the display panel 110. The processor 130 may adjust at least one of the feeding time or the strength of the driving current (or the driving voltage) provided to the backlight unit 120 and outputs the current. For example, the processor 130 may control the luminance of light sources included in the backlight unit 120 with pulse width modulation (PWM) wherein the duty ratio varies, or control the luminance of light sources of the backlight unit 120 by varying the strength of the current. The pulse width modulation (PWM) signal controls the ratio of turning-on and turning-off of the light sources, and the duty ratio (%) is determined according to a dimming value input from the processor 130.

In this case, the processor 130 may be implemented including a driver IC for operating the backlight unit 120. For example, the processor 130 may be implemented as a DSP, or as a digital driver IC and one chip. The driver IC may be implemented as hardware separate from the processor 130. For example, in case the light sources included in the backlight unit 120 are implemented as LEDs, the driver IC may be implemented as at least one LED driver controlling the current applied to the LEDs. According to an embodiment of the disclosure, the LED driver may be arranged on the rear end of a power supply (e.g., a switching mode power supply (SMPS)) and receive a voltage from the power supply. According to another embodiment, the LED driver may receive a voltage from a separate power device. It is possible that an SMPS and an LED driver may implemented as one integrated module.

The processor 130 according to an embodiment of the disclosure may control the amount of light of each of the plurality of light sources 121 according to an image signal. As an example, the processor 130 may independently operate each of the plurality of light sources 121 and turn on some of the light sources 121, and turn off the other light sources for implementing local dimming. The processor 130 may control the strength of the light emitted by each of the light sources 121 in a turned-on state. For example, in order that lights are not provided to one area on the display panel 110, the processor 130 may turn off the light sources 121 included in the light emitting block corresponding to the one area based on an image signal. The processor 130 may implement local dimming by increasing the strength and the amount of lights emitted by the light sources 121 included in a light emitting block corresponding to a specific area on the display panel 110 based on an image signal.

The processor 130 according to an embodiment of the disclosure may calculate the amount of the red (R) light, the amount of the green (G) light, and the amount of the blue (B) light that at least one light source among the plurality of light sources 121 emits to one area of the display panel 110.

The processor 130 may identify the color information of the one area based on each of the calculated amounts of the R light, the G light, and the B light.

A more detailed explanation in this regard will be made with reference to FIG. 4.

Figure 4:
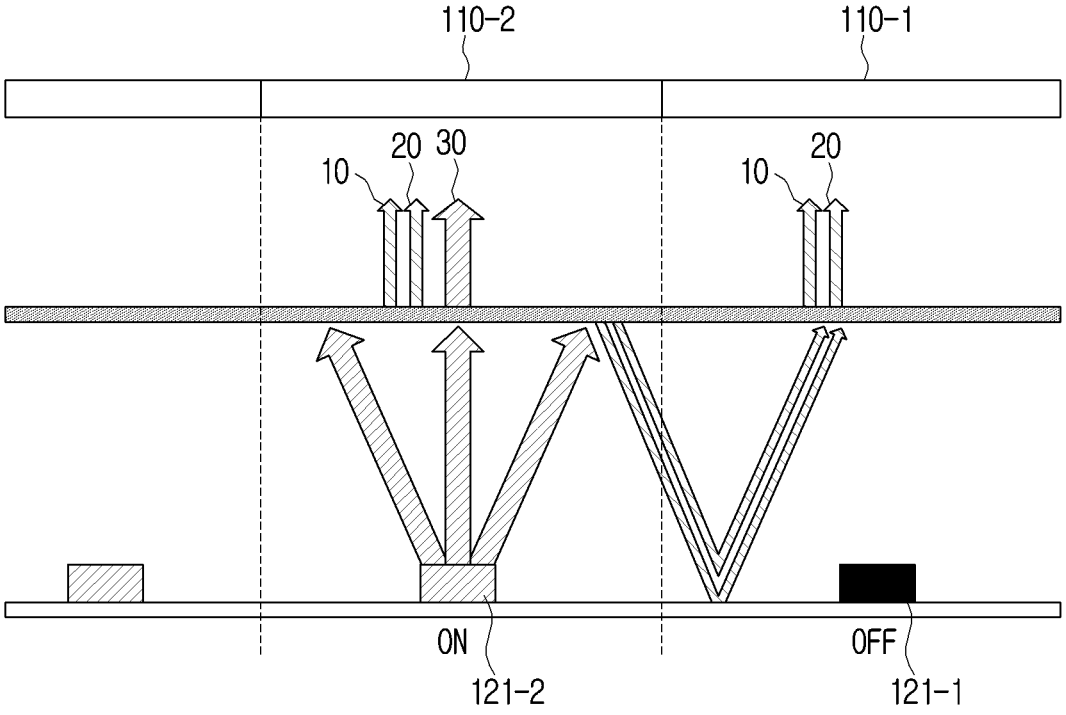
FIG. 4 is a diagram illustrating example local dimming according to an embodiment of the disclosure.

FIG. 4 is a diagram illustrating example local dimming according to an embodiment of the disclosure.

Referring to FIG. 4, the processor 130 may independently operate each of the plurality of light sources 121 based on an image signal for implementing local dimming. For example, the processor 130 may maintain the first light source 121-1 among the plurality of light sources 121 in a turned-off state, and maintain the second light source 121-2 in a turned-on state.

Here, a problem may exist, which is that, as the first light source 121-1 is in a turned-off state, light should not be provided to an area corresponding to the light emitting block including the first light source 121-1, e.g., the first area 110-1 on the display panel 110, but light is provided to the first area 110-1 according to light emission of adjacent light sources such as the second light source 121-2.

For example, some of the blue (B) light emitted by the second light source 121-2 may be reflected by the light sheet 122, and diffused to the first light emitting block. As the red (R) light and the blue (B) light diffused to the first light emitting block pass through the light sheet 122 and are provided to the first area 110-1, a problem that an unintended yellow color may be expressed in the first area 110-1 may occur. Accordingly, the processor 130 according to an embodiment of the disclosure may calculate or predict each of the amount of the R light, the amount of the G light, and the amount of the B light emitted to an area, and identify the color information of the one area based on each of the calculated amounts of the R light, the G light, and the B light. The processor 130 may adjust an image signal corresponding to the one area based on the identified color information.

Hereinafter, a method for calculating each of the amount of the R light, the amount of the G light, and the amount of the B light that the backlight unit 120 emits to one area of the display panel 110 as at least one light source emits light will be described in greater detail below with reference to FIGS. 5, 6 and 7.

Figure 5:
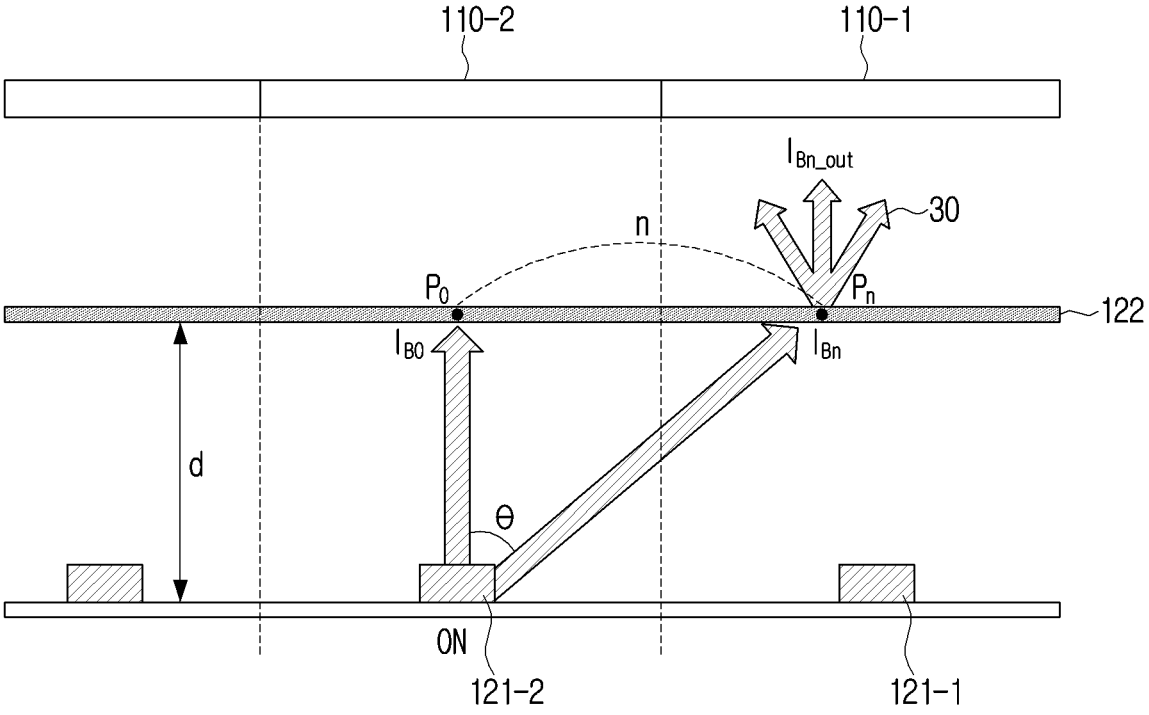
FIG. 5 is a diagram illustrating an example amount of a blue (B) light according to an embodiment of the disclosure.

FIG. 5 is a diagram illustrating an amount of a blue (B) light according to an embodiment of the disclosure.

According to an embodiment of the disclosure, when each of the plurality of light sources 121 is in a turned-on state, the blue (B) light emitted from each of the plurality of light sources 121, a reflective light by the light sheet 122, a light of which wavelength has been changed by the light sheet 122, etc. are in equilibrium, and white light of the same (or, similar) wavelengths may be provided to each area of the display panel 110.

According to an embodiment of the disclosure, when the processor 130 turns off the light source 121-1 according to an image signal, as some of the light emitted from the light sources included in another light emitting block are provided to the first area 110-1 corresponding to the first light emitting block including the first light source 121-1 in a turned-off state, a phenomenon wherein a yellow color may be expressed in the first area 110-1 (hereinafter, referred to as a yellowing phenomenon) may occur.

The processor 130 according to an embodiment of the disclosure may calculate the amount of light diffused to the first light emitting block among the light emitted by the second light source 121-2 included in the second light emitting block adjacent to the first light emitting block.

Referring to FIG. 5, according to an embodiment of the disclosure, the blue (B) light emitted by the second light source 121-2 is diffused to several points on the light sheet 122. As the distance from the second light source 121-2 becomes greater, the strength of a blue (B) light reaching the light sheet 122 becomes weaker, and thus the strength of the blue (B) light reaching each point on the light sheet 122 varies.

The amount of the blue (B) light that the backlight unit 120 emits to an area on the display panel 110, e.g., the first area 110-1 may correspond, for example, to the amount of the blue (B) light 30 emitted from a $P_n$ point of the light sheet 122 corresponding to the first area 110-1.

If the second light source 121-2 is in a turned-on state, and a light emitted from the second light source 121-2 is emitted in a vertical direction and reaches a $P_0$ point on the light sheet 122, the amount of the blue (B) light on the $P_0$ point is $I_{B0}$. The amount of the blue (B) light reaching a $P_n$ point that is distant from $I_{B0}$ by a distance n is $I_{Bn}$. In this case, the relation between $I_{B0}$ and $I_{Bn}$ can be expressed by the following formula 1.

$$I_{bn} = I_{b0} \cdot \cos\theta = I_{b0} \cdot \frac{d}{\sqrt{(n^2 + d^2)}} \quad \text{[Formula 1]}$$

Here, d is the distance between the light source 121 and the light sheet 122.

Some of the amount of the blue (B) lights $I_{Bn}$ reaching the $P_n$ point may be converted into red (R) light and green (G) light by the light sheet 122. The other light among the amount of the blue (B) lights $I_{Bn}$ reaching the $P_n$ point may pass through the light sheet 122 as the blue (B) light without their wavelengths being changed. According to an embodiment of the disclosure, if the rate of change of the red wavelength of the light sheet 122 is represented as $C_R$, and the rate of change of the green wavelength is represented as $C_G$, the amount of the blue (B) light $I_{Bn_out}$ 30 passing through the light sheet on the $P_n$ point can be expressed by the following formula 2.

$$I_{(Bn_out)} = I_{Bn} \cdot (1 - C_R - C_B) \quad \text{[Formula 2]}$$

Hereinafter, a method for the processor 130 to calculate the amount of the red (R) light emitted from the $P_n$ point will be described in greater detail below.

Figure 6:
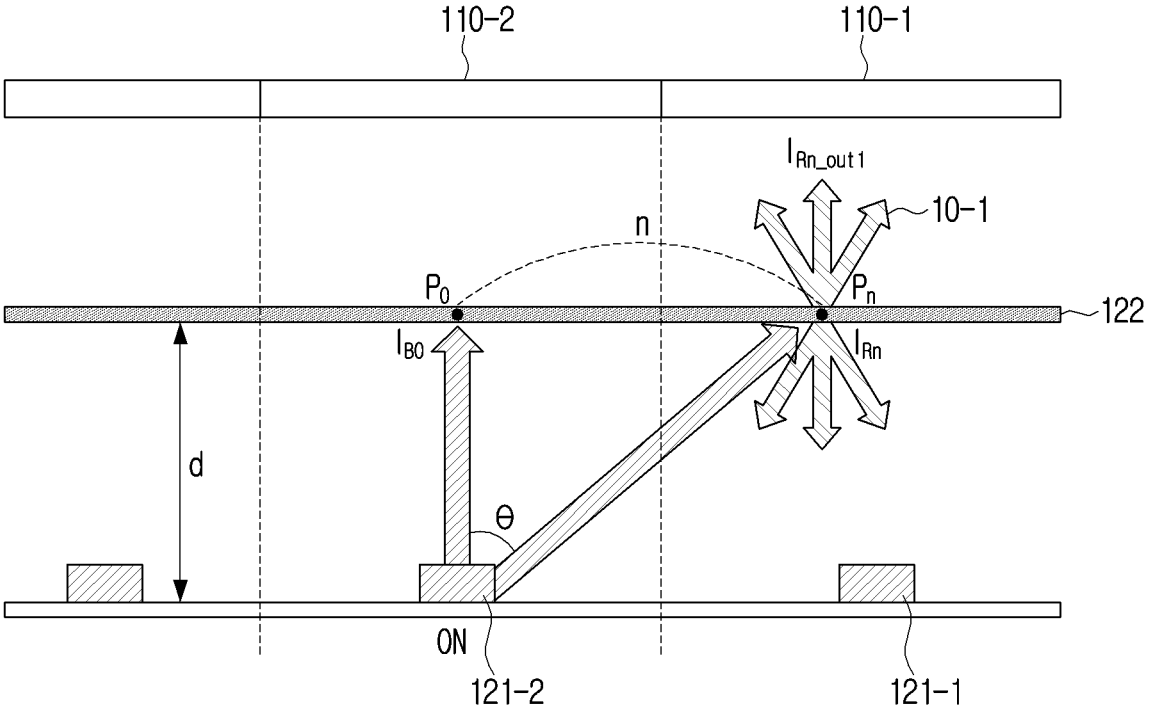
FIG. 6 is a diagram illustrating an example amount of a red (R) light according to an embodiment of the disclosure.

FIG. 6 is a diagram illustrating an amount of a red (R) light according to an embodiment of the disclosure.

Referring to FIG. 6, according to an embodiment of the disclosure, the blue (B) light emitted by the second light source 121-2 may be diffused to several points on the light sheet 122.

As calculated in the description regarding FIG. 5, the amount of the blue (B) light reaching the $P_n$ point is $I_{Bn}$. If the rate of change of the red wavelength of the light sheet 122 is represented as $C_R$, the amount of the blue (B) light reaching the $P_n$ point is $I_{Bn}$, and the amount of the red (R) light $I_{Rn}$ on the $P_n$ point can be expressed by the following formula 3.

$$I_{Rn} = I_{Bn} \cdot C_R \quad \text{[Formula 3]}$$

Here, half of the amount of the red (R) light $I_{Rn}$ on the $P_n$ point is diffusively reflected, and the other half passes through the light sheet 122, and thus the amount of the red (R) light $I_{Rn_out1}$ (10-1) emitted from the $P_n$ point can be expressed by the following formula 4.

$$I_{Rn_out1} = 0.5 \cdot I_{Rn} \quad \text{[Formula 4]}$$

A case in which half of the amount of light is diffusively reflected, and the other half passes through the light sheet 122 is merely an example, and the disclosure is not limited to specific numbers.

Hereinafter, a method of calculating the amount of red (R) light in a case wherein light emitted from the second light source 121-2 are reflected on the light sheet 122 corresponding to another light emitting block and then reach the light sheet 122 corresponding to the first light emitting block, e.g., the $P_n$ point will be described in greater detail, in addition to a case wherein lights emitted from the second light source 121-2 directly reach the light sheet 122 corresponding to the first light emitting block.

Figure 7:
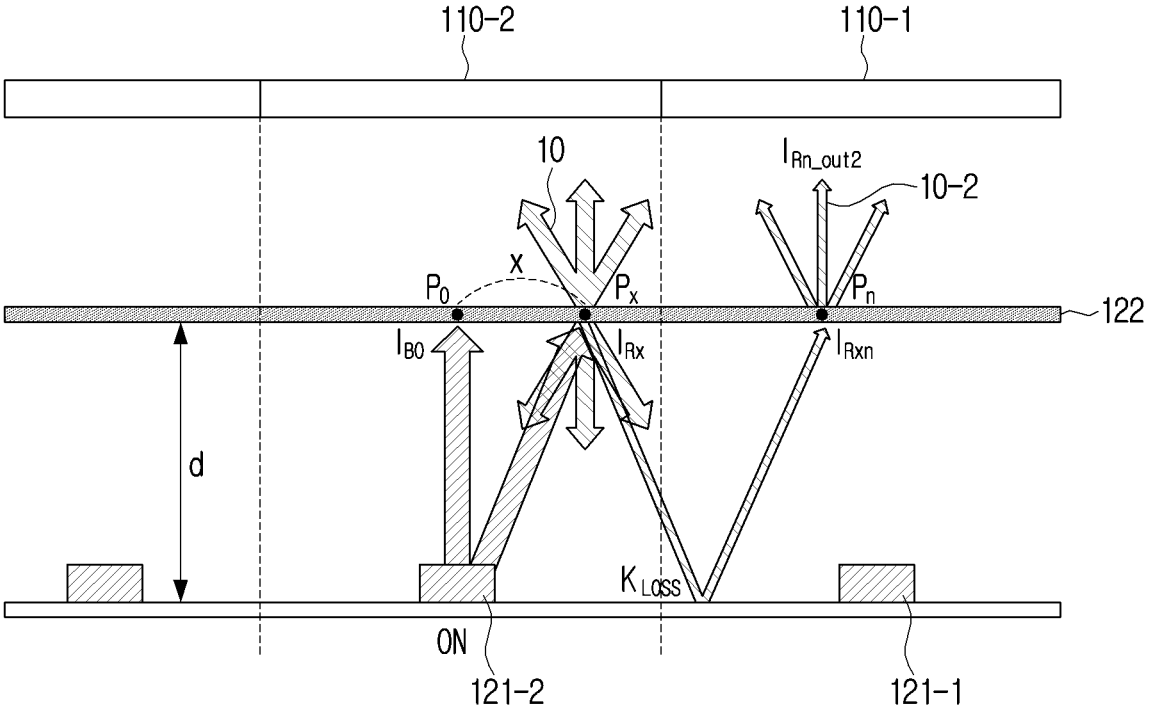
FIG. 7 is a diagram illustrating an example amount of a red (R) light according to an embodiment of the disclosure.

FIG. 7 is a diagram illustrating an amount of a red (R) light according to an embodiment of the disclosure.

FIG. 6 is a diagram for illustrating the amount of red (R) light $I_{Rn_out1}$ (10-1) emitted from the $P_n$ point in a case wherein the blue (B) light emitted from the second light source 121-2 directly reach the $P_n$ point and are converted into red (R) light by the light sheet 122.

FIG. 7 is an example different from the example illustrated in FIG. 6, and is a diagram illustrating the amount of red (R) light $I_{Rn_out2}$ (10-2) emitted from the $P_n$ point in a case wherein the blue (B) light emitted from the second light source 121-2 are diffusively reflected on the light sheet 122 and then reach the $P_n$ point.

Referring to FIG. 7, the wavelengths of the light emitted from the second light source 121-2 may be changed by the light sheet 122 after reaching between the $P_0$ point and the $P_n$ point. Some of the red (R) light of which wavelengths have been changed by the light sheet 122 may be diffusively reflected to the inside of the backlight unit 120 and reach the $P_n$ point.

According to an embodiment of the disclosure, in a case in which the blue (B) light emitted by the second light source 121-2 reach a random $P_x$ point between the $P_0$ point and the $P_n$ point on the light sheet 122, and are then converted into red (R) light by the light sheet 122, the amount of the red (R) lights $I_{Rx}$ on the $P_x$ point may be calculated. As calculated in the description regarding FIG. 6, $I_{Rx}$ may be calculated based on the rate of change of the red wavelengths of the light sheet 122 and the rate of transmittance of the light sheet 122, etc.

The amount of the red (R) light $I_{Rx}$ on the $P_x$ point may be diffusively reflected and dispersed in all directions inside the backlight block 120. The amount of the light $I_{R\times n}$ reaching the $P_n$ point among the amount of the red (R) light $I_{Rx}$ dispersed in all directions can be expressed by the following formula 5.

$$I_{Rxn} = \frac{I_{Rx}}{2\pi\sqrt{(n-x)^2 + 4d^2}} \quad \text{[Formula 5]}$$

Here, x may refer, for example, to the distance between $P_0$ and $P_x$ on the light sheet 122, n may refer, for example, to the distance between $P_0$ and $P_n$ on the light sheet 122, and d may refer, for example, to the distance between the light sources 121 and the light sheet 122.

According to the material of the reflective plate inside the backlight unit 120, loss may occur during reflection of lights, and if this is represented as $K_{loss}$, the amount of the lights $I_{R\times n}$ reaching the $P_n$ point among the amount of the red (R) light $I_{Rx}$ dispersed in all directions on the $P_x$ point can be expressed by the following formula 6.

$$I_{Rxn} = \frac{I_{Rx}}{2\pi\sqrt{(n-x)^2 + 4d^2}} \cdot K_{loss} \quad \text{[Formula 6]}$$

Ultimately, diffusive reflection occurs on several points between the $P_0$ and $P_n$ points other than a random $P_x$ point, and the total amount of the red (R) light $I_{Rn_out2}$ diffusively reflected on each point and reaching the $P_n$ point can be expressed by the following formula 7.

$$I_{Rn_out2}=\int_0^n I_{R\times n(x)}dX \quad \text{[Formula 7]}$$

For the convenience of explanation, explanation was made based on the assumption of different cases for each of FIG. 6 and FIG. 7, but the case illustrated in FIG. 6 and the case illustrated in FIG. 7 occur simultaneously. Accordingly, the total amount of the red (R) light $I_{Rn_out}$ 10 emitted from the $P_n$ point can be expressed by the following formula 8.

$$I_{Rn_out}=I_{Rn_out1}+I_{Rn_out2}=(0.5\cdot I_{Rn})+\int_0^n I_{R\times n(x)}dx \quad \text{[Formula 8]}$$

For the convenience of explanation, FIG. 6 and FIG. 7 were illustrated based on the assumption of only the total amount of the red (R) light $I_{Rn_out}$ 10 emitted from the $P_n$ point, but the processor 130 according to an embodiment of the disclosure may calculate the total amount of the green (G) light $I_{Gn_out}$ 20 emitted from the $P_n$ point in the same way. As an example, the formulae 3, 4, 5, 6, 7 and 8 can be applied in the same way in calculation of the total amount of the green (G) light $I_{Gn_out}$ 20 emitted from the $P_n$ point. For example, the total amount of the green (G) light $I_{Gn_out}$ 20 emitted from the $P_n$ point can be expressed by the following formula 9.

$$I_{Gn_out}=I_{Gn_out1}+_{Gn_out2}=(0.5\cdot I_{Gn})+\int_0^n I_{G\times n(x)}dx \quad \text{[Formula 9]}$$

Returning to FIG. 2, the processor 130 according to an embodiment of the disclosure may calculate the color information of one area, e.g., the first area 110-1 based on the calculated amount of the red (R) light, amount of the green (G) light, and amount of the blue (B) light. The processor 130 may adjust an image signal corresponding to the one area based on the calculated color information.

In FIGS. 3, 4, 5, 6 and 7, the amount of the red (R) light, the amount of the green (G) light, and the amount of the blue (B) light emitted to the first area 110-1 corresponding to the first light emitting block were calculated in consideration of only light emission of the second light source 121-2 included in the second light emitting block adjacent to the first light emitting block.

Figure 8:
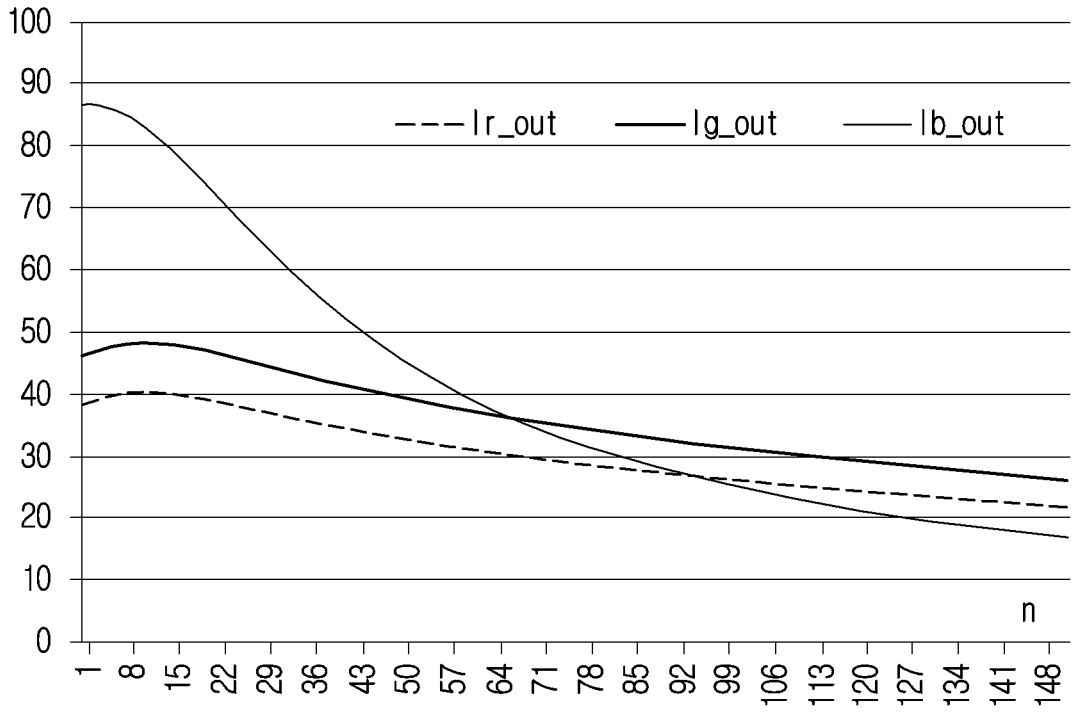
FIG. 8 is a diagram illustrating information on amounts of lights of the RGB according to an embodiment of the disclosure.

According to an embodiment of the disclosure, in a state wherein one light source is turned on, based on the distance between one area and the light source in a turned-on state, the amount of the red (R) light, the amount of the green (G) light, and the amount of the blue (B) light emitted to the one area may be acquired as in the graph in FIG. 8. Hereinafter, the graph in FIG. 8 will be explained in greater detail.

FIG. 8 is a diagram illustrating information on example amounts of lights of the RGB according to an embodiment of the disclosure.

Referring to FIG. 8, the x axis may refer, for example, to the distance between a light source in a turned-on state and the $P_n$ point on the light sheet 122, and the y axis may refer, for example, to the amount of red (R) light, the amount of green (G) light, and the amount of blue (B) light emitted from the $P_n$ point and provided to an area.

Returning to FIG. 2, the display apparatus 100 according to an embodiment of the disclosure may calculate the amount of red (R) light, the amount of green (G) light, and the amount of blue (B) light emitted to an area based on the formulae 1, 2, 3, 4, 5, 6, 7, 8 and 9. Also, as in the graph illustrated in FIG. 8, the display apparatus 100 may store, in advance, information on each of the amount of red (R) light, the amount of green (G) light, and the amount of blue (B) light according to the distance between at least one light source among the plurality of light sources 121 and an area of the display panel 110.

According to an embodiment of the disclosure, the display apparatus 100 may store information on each of the amount of red (R) light, the amount of green (G) light, and the amount of blue (B) light according to the distance between at least one light source in a turned-on state among the plurality of light sources 121 and an area of the display panel 110.

Where the display apparatus 100 displays an image signal, the plurality of light sources 121 may be selectively turned on for implementation of local dimming According to an embodiment of the disclosure, the processor 130 calculates the amount of red (R) light, the amount of green (G) light, and the amount of blue (B) light provided to an area in consideration of at least two light sources in a turned-on state. This will be described in greater detail below with reference to FIG. 9.

Figure 9:
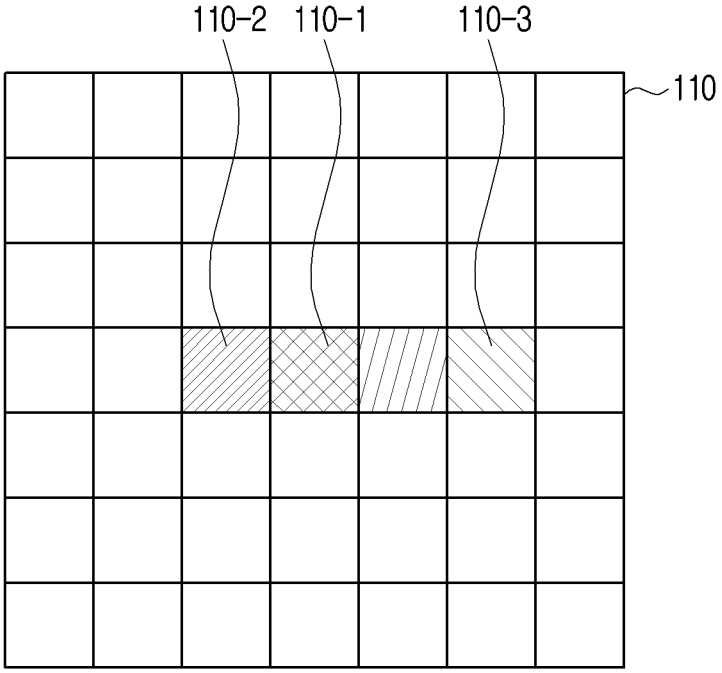
FIG. 9 is a diagram illustrating an amount of a light emitted to one area according to an embodiment of the disclosure.

FIG. 9 is a diagram illustrating an example amount of a light radiated to one area according to an embodiment of the disclosure.

Referring to FIG. 9, the display panel 110 may be divided into a plurality of areas, and the processor 130 may implement local dimming corresponding to an image signal by independently operating light sources (or, light emitting blocks) corresponding to each of the plurality of areas.

For example, in a case in which a light source corresponding to the first area 110-1 among the plurality of areas is in a turned-off state, and light sources corresponding to each of the second area 110-2 and the third area 110-3 are in a turned-on state may be assumed. According to an embodiment of the disclosure, the light source corresponding to the first area 110-1 is in a turned-off state, and thus low luminance or a black color should be expressed, but as some of the light emitted from the light source corresponding to the second area 110-2 and the light source corresponding to the third area 110-3 are provided to the first area 110-1 directly or after being reflected, a problem that an unintended yellow color being expressed in the first area 110-1 may occur.

The processor 130 according to an embodiment of the disclosure may identify the color information of an area based on the sum of an amount of a red (R) light, an amount of a green (G) light, and an amount of a blue (B) light emitted from a first light source among the plurality of light sources to the one area and an amount of a red (R) light, an amount of a green (G) light, and an amount of a blue (B) light emitted from a second light source among the plurality of light sources to the one area.

For preventing and/or reducing the problem that an unintended yellow color is expressed in the first area 110-1, the processor 130 may calculate the amount of the red (R) light, the amount of the green (G) light, and the amount of the blue (B) light emitted from a light source corresponding to the second area 110-2 and provided to the first area 110-1. The processor 130 may calculate the amount of the red (R) light, the amount of the green (G) light, and the amount of the blue (B) light emitted from a light source corresponding to the third area 110-3 and provided to the first area 110-1.

In addition, the processor 130 according to an embodiment of the disclosure may calculate the amount of the red (R) light, the amount of the green (G) light, and the amount of the blue (B) light provided to the first area 110-1 based on information on the amount of the light of each of the RGB as illustrated, for example, in FIG. 8 stored in the display apparatus 100.

For example, if the distance between light sources corresponding to the first area 110-1 and the second area 110-2 is 50, the processor 130 may calculate each of the amount of the red (R) light, the amount of the green (G) light, and the amount of the blue (B) light corresponding to the distance 50 as 33, 40, and 55, respectively, based on the graph illustrated in FIG. 8. If the distance between light sources corresponding to the first area 110-1 and the third area 110-3 is 100, the processor 130 may calculate each of the amount of the red (R) light, the amount of the green (G) light, and the amount of the blue (B) light corresponding to the distance 100 as 27, 32, and 26, respectively, based on the graph illustrated in FIG. 8. The processor 130 may calculate (or, identify) each of the amount of the red (R) light, the amount of the green (G) light, and the amount of the blue (B) light provided to an area by lights emitted from a light source located in an adjacent distance to the one area.

According to an embodiment of the disclosure, the processor 130 may respectively calculate the amount of the red (R) light 60 (33+27), the amount of the green (G) light 72 (40+32), and the amount of the blue (B) light 71 (45+26) provided to the first area 110-1.

For convenience of explanation, a description was made based on the assumption of a case of calculating an influence that some of the light emitted from two light sources exert on one area or the amount of the red (R) light, the amount of the green (G) light, and the amount of the blue (B) light provided to an area among the amounts of light emitted from two light sources, but the processor 130 can calculate each of the amount of the red (R) light, the amount of the green (G) light, and the amount of the blue (B) light provided to an area by light emitted from at least three light sources.

For convenience of explanation, a description was made based on the assumption of a case wherein two light sources emit lights by the same strength, but each of a plurality of light sources can emit lights by different strengths.

For example, if the distance between light sources corresponding to the first area 110-1 and the second area 110-2 is 50, the processor 130 may calculate each of the amount of the red (R) light, the amount of the green (G) light, and the amount of the blue (B) light corresponding to the distance 50 as 33, 40, and 55, respectively, based on the graph illustrated in FIG. 8. If the distance between light sources corresponding to the first area 110-1 and the third area 110-3 is 100, the processor 130 may calculate each of the amount of the red (R) light, the amount of the green (G) light, and the amount of the blue (B) light corresponding to the distance 100 as 27, 32, and 26, respectively, based on the graph illustrated in FIG. 8. If the strength of the light emitted from the light source corresponding to the third area 110-3 is two times bigger than the strength of the light emitted from the light source corresponding to the second area 110-2, the processor 130 may calculate each of the amount of the red (R) light, the amount of the green (G) light, and the amount of the blue (B) light as 54 (27×2), 64 (32×2), and 52 (26×2), respectively.

The processor 130 may respectively calculate the amount of the red (R) light 87 (33+54), the amount of the green (G) light 104 (40+64), and the amount of the blue (B) light 97 (45+52) provided to the first area 110-1. Hereinafter, a method of identifying the color information of one area based on each of the calculated amounts of the R light, the G light, and the B light will be described in greater detail.

Figure 10:
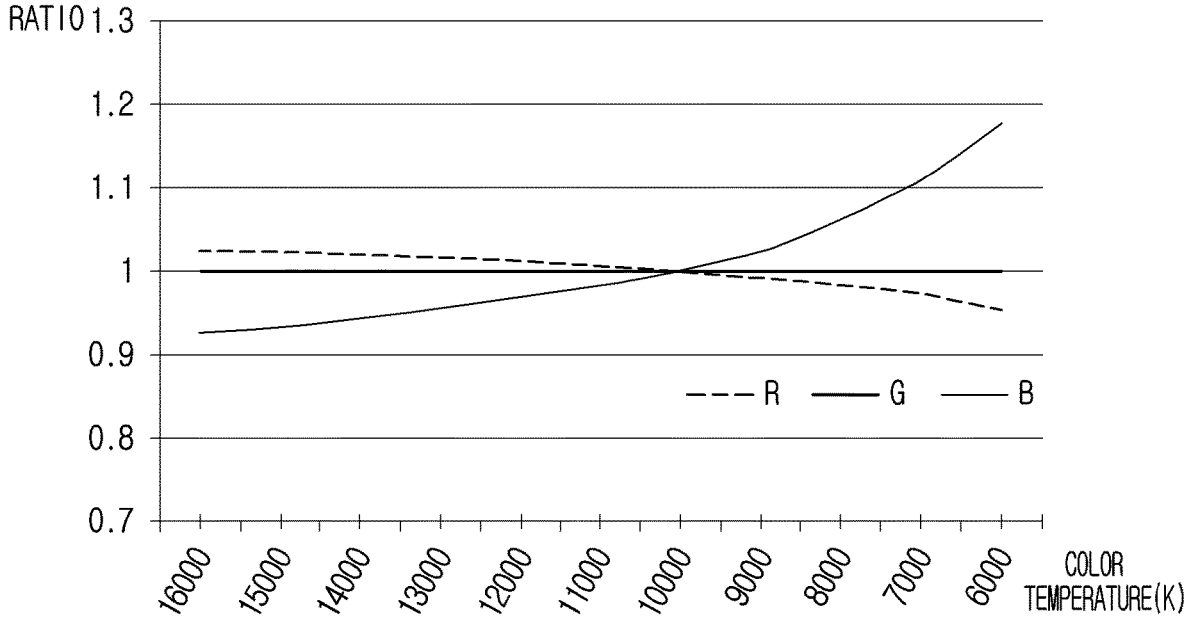
FIG. 10 is a diagram illustrating information on a ratio of the strength of RGB image signals for each color information according to an embodiment of the disclosure.

FIG. 10 is a diagram illustrating example information on the ratio of the strength of RGB image signals for each color information according to an embodiment of the disclosure.

The processor 130 according to an embodiment of the disclosure may identify color information based on conversion of each of the calculated amounts of the R light, the G light, and the B light to a color coordinate. Color information may refer, for example, to a color temperature.

As an example, the processor 130 may define the amounts of lights of each of R, G, and B emitted to an area as $I_{Rn_out}$, $I_{Gn_out}$, and $I_{Bn_out}$, and sum the influences by the light sources in a turned-on state and thereby calculate the RGB values.

Also, the processor 130 according to an embodiment of the disclosure may convert the R, G, and B into X, Y, and Z coordinates using an RGB to XYZ conversion matrix based on the RGB values, and acquire a color coordinate or a color temperature based on the X, Y, and Z coordinates. For example, the processor 130 may acquire X, Y, and Z coordinates corresponding to the calculated RGB values based on the following formula 10.

$$\begin{bmatrix} X \\ Y \\ Z \end{bmatrix} = \frac{1}{m_{21}} \begin{bmatrix} m11 & m12 & m13 \\ m21 & m22 & m23 \\ m31 & m32 & m33 \end{bmatrix} \begin{bmatrix} R \\ G \\ B \end{bmatrix} \quad \text{[Formula 10]}$$

The processor 130 may acquire xy values corresponding to the acquired X, Y, and Z coordinates based on the following formula 11. The processor 130 may identify a color coordinate and a color temperature corresponding to an area based on the xy values.

$$x = \frac{X}{X+Y+Z},\ y = \frac{Y}{X+Y+Z} \quad \text{[Formula 11]}$$

The processor 130 according to an embodiment of the disclosure may identify whether a yellowing phenomenon occurred in an area based on the identified color temperature.

The processor 130 may adjust the ratio between a red (R) signal, a green (G) signal, and a blue (B) signal of an image signal corresponding to the one area based on the color information.

According to an embodiment of the disclosure, if all of the plurality of light sources 121 provided on the display apparatus 100 are in a turned-on state, the blue (B) light emitted from each of the plurality of light sources 121, a reflective light by the light sheet 122, a light of which wavelength has been changed by the light sheet 122, etc. are in equilibrium, and white light of the same (or, similar) wavelengths may be provided to each area of the display panel 110. For example, it may be a state wherein a yellowing phenomenon did not occur in each of the plurality of areas provided on the display panel 110. For example, if the color temperature of an area when it is a state wherein a yellowing phenomenon did not occur or a state wherein all light sources are in a turned-on state is assumed as a threshold temperature (e.g., 10000K), the ratio among a red (R) signal, a green (G) signal, and a blue (B) signal at the threshold temperature may be 1:1:1.

TABLE 1

| | Color Temperature K | | | | | | | | | | |
|---|---|---|---|---|---|---|---|---|---|---|---|
| | 16000 | 15000 | 14000 | 13000 | 12000 | 11000 | 10000 | 9000 | 8000 | 7000 | 6000 |
| R | 1.026 | 1.023 | 1.02 | 1.016 | 1.013 | 1.007 | 1 | 0.993 | 0.984 | 0.973 | 0.954 |
| G | 1 | 1 | 1 | 1 | 1 | 1 | 1 | 1 | 1 | 1 | 1 |
| B | 0.926 | 0.934 | 0.944 | 0.956 | 0.969 | 0.983 | 1 | 1.024 | 1.061 | 1.109 | 1.177 |

If the color temperature according to color information corresponding to an area is greater than or equal to a threshold temperature, the processor 130 according to an embodiment of the disclosure may adjust the ratio between an R signal, a G signal, and a B signal such that the strength of the B signal is relatively increased compared to the strength of the R signal and the G signal. For example, if the amount of the blue (B) light provided to an area is greater than the amount of the red (R) light and the amount of the green (G) light, the color temperature of the one area is higher than a threshold temperature (e.g., 10000K). In this case, the processor 130 may adjust the color temperature of the one area to be 10000K by reducing the ratio of blue (B) pixels or increasing the ratio of green (G) pixels or the ratio of red (R) pixels.

As another example, if the color temperature according to color information corresponding to an area is less than a threshold temperature, the processor 130 may adjust the ratio between an R signal, a G signal, and a B signal such that the strength of the B signal is relatively decreased compared to the strength of the R signal and the G signal. For example, if the amount of the blue (B) light provided to an area is less than the amount of the red (R) light and the amount of the green (G) light, the color temperature of the one area is lower than a threshold temperature (e.g., 10000K). In this case, the processor 130 may adjust the color temperature of the one area to be 10000K by increasing the ratio of blue (B) pixels or reducing the ratio of green (G) pixels or the ratio of red (R) pixels. In FIG. 10, adjustment of green (G) pixels was reduced to reduce a change of luminance according to change of pixel ratios, but this is merely an example, and the disclosure is not limited thereto.

Figure 11:
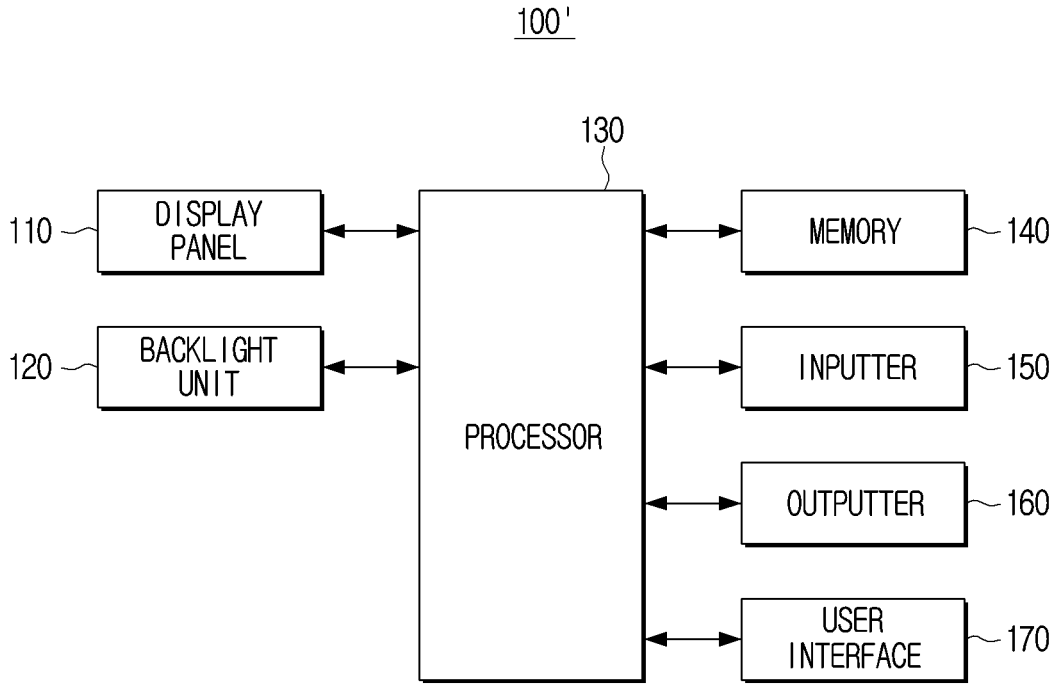
FIG. 11 is a block diagram illustrating an example display apparatus according to an embodiment of the disclosure.

FIG. 11 is a block diagram illustrating an example display apparatus according to an embodiment of the disclosure.

The display apparatus 100' according to an embodiment of the disclosure may include a display panel 110, a backlight unit (e.g., a backlight) 120, a processor (e.g., including processing circuitry) 130, a memory 140, an inputter (e.g., including input circuitry) 150, an outputter (e.g., including output circuitry) 160, and a user interface (e.g., including user interface circuitry) 170. Among the components illustrated in FIG. 11, regarding the components overlapping with the components illustrated in FIG. 2, detailed explanation may not be repeated here.

The memory 140 according to an embodiment of the disclosure may store information on each of the amount of the red (R) light, the amount of the green (G) light, and the amount of the blue (B) light according to the distance between at least one light source in a turned-on state among the plurality of light sources 121 and an area of the display panel 110.

The memory 140 according to an embodiment of the disclosure may store information on the ratio of the strength of RGB image signals for each color information as illustrated, for example, in Table 1 or the graph illustrated in FIG. 10. The processor 130 according to an embodiment may adjust the ratio among an R signal, a G signal, and a B signal of an image signal corresponding to an area based on information on the ratio of the strength of RGB image signals for each color information stored in the memory 140.

The memory 140 may be electronically connected with the processor 130 and may store data necessary for the various embodiments of the disclosure. For example, the memory 140 may be implemented, for example, and without limitation, as an internal memory such as a ROM (e.g., an electrically erasable programmable read-only memory (EEPROM)) and a RAM included in the processor 130, or as a memory separate from the processor 130, or the like.

The memory 140 may be implemented in the form of a memory embedded in the display apparatus 100, or in the form of a memory that can be attached to or detached from the display apparatus 100 according to the use of stored data. For example, in the case of data for operating the display apparatus 100, the data may be stored in a memory embedded in the display apparatus 100, and in the case of data for an extension function of the display apparatus 100, the data may be stored in a memory that can be attached to or detached from the display apparatus 100. In the case of being implemented as a memory embedded in the display apparatus 100, the memory 140 may be at least one of a volatile memory (e.g.: a dynamic RAM (DRAM), a static RAM (SRAM), or a synchronous dynamic RAM (SDRAM), etc.) or a non-volatile memory (e.g.: an one time programmable ROM (OTPROM), a programmable ROM (PROM), an erasable and programmable ROM (EPROM), an electrically erasable and programmable ROM (EEPROM), a mask ROM, a flash ROM, a flash memory (e.g.: NAND flash or NOR flash, etc.), a hard drive, or a solid state drive (SSD)).

In the case of being implemented as a memory that can be attached to or detached from the display apparatus 100, the memory 140 may be a memory card (e.g., compact flash (CF), secure digital (SD), micro secure digital (Micro-SD), mini secure digital (Mini-SD), extreme digital (xD), multimedia card (MMC), etc.), an external memory that can be connected to a USB port (e.g., a USB memory), etc.

The inputter 150 may include various input circuitry and receives inputs of contents in various types. For example, the inputter 150 may receive an input of an image signal by a streaming or download method from an external apparatus (e.g., a source apparatus), an external storage medium (e.g., a USB memory), an external server (e.g., a web hard) through communication methods such as Wi-Fi based on AP (Wi-Fi, a wireless LAN network), Bluetooth, Zigbee, a wired/wireless local area network (LAN), a wide area network (WAN), Ethernet, IEEE 1394, a high-definition multimedia interface (HDMI), a universal serial bus (USB), a mobile high-definition link (MHL), Audio Engineering Society/European Broadcasting Union (AES/EBU), optical and coaxial. Here, an image signal may be a digital image signal among one of a standard definition (SD) image, a high definition (HD) image, a full HD image, or an ultra HD image, but is not limited thereto.

The outputter 160 may include various output circuitry and may output an audio signal. For example, the outputter 160 may convert a digital audio signal processed at the processor 130 into an analog audio signal and amplify the signal, and output the signal. For example, the outputter 160 may include at least one speaker unit, D/A converter, audio amplifier, etc. that can output at least one channel According to an embodiment of the disclosure, the outputter 160 may be implemented to output various multi-channel audio signals. In this case, the processor 130 may control the outputter 160 to perform enhance-processing on an audio signal input to correspond to enhance-processing of an input image and output the signal. For example, the processor 130 may convert an input two-channel audio signal into a virtual multi-channel (e.g., a 5.1 channel) audio signal, or recognize the location wherein the display apparatus 100' is placed and process the signal as a stereoscopic audio signal optimized for the space, or provide an audio signal optimized according to the type (e.g., the genre of a content) of an input image.

The user interface 170 may include various user interface circuitry and be implemented as an apparatus such as a button, a touch pad, a mouse, and a keyboard, or as a touch screen, a remote control transceiver, etc. that can perform the aforementioned display function and also a manipulation input function. The remote control transceiver may receive a remote control signal from an external remote control apparatus through at least one communication methods among infrared communication, Bluetooth communication, or Wi-Fi communication, or transmit a remote control signal.

The display apparatus 100' may additionally include a tuner and a demodulation part depending on implementation examples. The tuner (not shown) may receive an RF broadcast signal by tuning a channel selected by a user among radio frequency (RF) broadcast signals received through an antenna or all pre-stored channels. The demodulation part (not shown) may receive a digital IF signal (DIF) converted at the tuner and demodulate the signal, and perform channel demodulation, etc. According to an embodiment of the disclosure, an input image received through the tuner may be processed through the demodulation part (not shown), and then provided to the processor 130 for image processing according to an embodiment of the disclosure.

Figure 12:
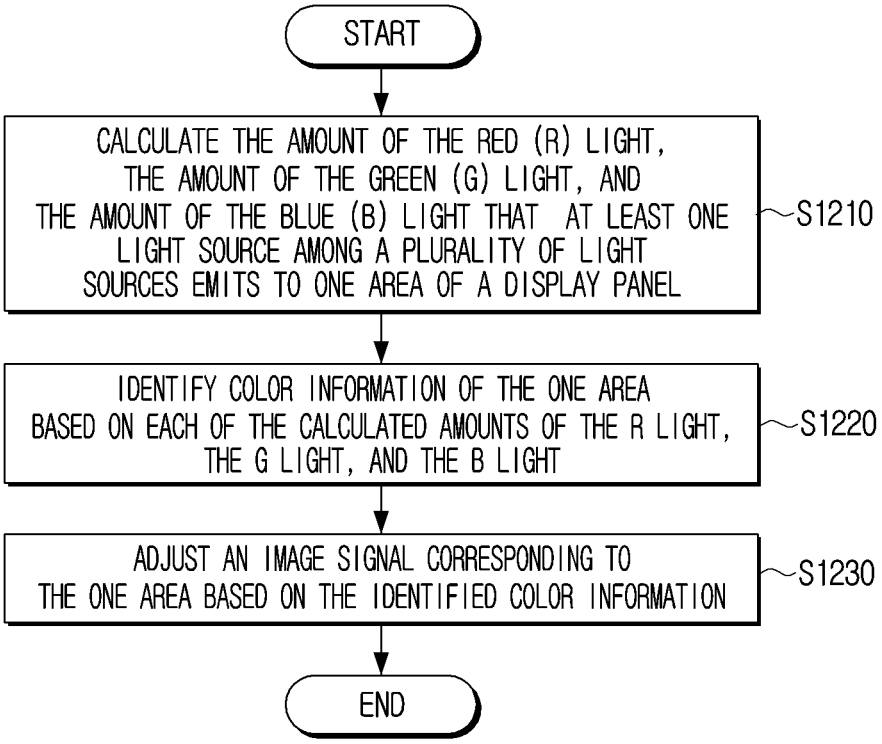
FIG. 12 is a flowchart illustrating an example method of controlling a display apparatus according to an embodiment of the disclosure.

FIG. 12 is a flowchart illustrating an example method of controlling a display apparatus according to an embodiment of the disclosure.

In a method of controlling a display apparatus including a backlight unit including a plurality of light sources, and independently operating a light emitting block corresponding to each of the plurality of light sources to provide lights to a display panel according to an embodiment of the disclosure, an amount of a red (R) light, an amount of a green (G) light, and an amount of a blue (B) light that at least one light source among the plurality of light sources emits to one area on the display panel are calculated at operation S1210.

The color information of the one area is identified based on each of the calculated amounts of the R light, the G light, and the B light at operation S1220.

An image signal corresponding to the one area is adjusted based on the identified color information at operation S1230.

The operation S1220 of identifying color information may include identifying the color information of the one area based on the sum of an amount of a red (R) light, an amount of a green (G) light, and an amount of a blue (B) light that a first light source among the plurality of light sources emits to the one area and an amount of a red (R) light, an amount of a green (G) light, and an amount of a blue (B) light that a second light source among the plurality of light sources emits to the one area.

Operation S1220 of identifying color information may include identifying the color information based on conversion of each of the calculated amounts of the R light, the G light, and the B light to a color coordinate.

The color information may include a color temperature.

The one area according to an embodiment of the disclosure may be an area corresponding to at least one light emitting block among the plurality of light emitting blocks or an area corresponding to at least one among the plurality of pixels on the display panel.

Operation S1230 of adjusting an image signal may include adjusting a ratio among a red (R) signal, a green (G) signal, and a blue (B) signal of an image signal corresponding to the one area based on the identified color information.

Operation S1230 of adjusting an image signal may include, based on a color temperature according to the identified color information being greater than or equal to a threshold temperature, adjusting the ratio among the R signal, the G signal, and the B signal such that the strength of the B signal relatively increases compared to the strength of the R signal and the G signal, and based on a color temperature according to the identified color information being less than a threshold temperature, adjusting the ratio among the R signal, the G signal, and the B signal such that the strength of the B signal relatively decreases compared to the strength of the R signal and the G signal.

Operation S1230 of adjusting an image according to an embodiment of the disclosure may include reading the ratio of the strength of RGB image signals corresponding to the identified color information from a memory storing information on the ratio of the strength of RGB image signals for each color information and adjusting the ratio among the R signal, the G signal, and the B signal of an image signal corresponding to the one area.

The various example embodiments of the disclosure may be applied not only to display apparatuses, but also to all electronic apparatuses that can perform image processing such as an image receiving apparatus such as, for example, and without limitation, a set top box, an image processing apparatus, etc.

The various example embodiments described above may be implemented in a recording medium that can be read by a computer or an apparatus similar to a computer, using software, hardware, or a combination thereof. In some cases, the embodiments described in this disclosure may be implemented by the processor 120 itself. According to implementation by software, the embodiments such as processes and functions described in this disclosure may be implemented by separate software modules. Each of the software modules can perform one or more functions and operations described in this specification.

Computer instructions for performing processing operations of a display apparatus according to the aforementioned various example embodiments of the disclosure may be stored in a non-transitory computer-readable medium. Such computer instructions stored in a non-transitory computer-readable medium make the processing operations at the display apparatus according to the aforementioned various example embodiments performed by a specific machine, when the instructions are executed by the processor of the specific machine.

A non-transitory computer-readable medium may refer, for example, to a medium that stores data semi-permanently, and is readable by machines. As examples of a non-transitory computer-readable medium, there may be a CD, a DVD, a hard disk, a blue-ray disk, a USB, a memory card, a ROM and the like.

While various example embodiments of the disclosure have been illustrated and described, the disclosure is not limited to the aforementioned embodiments, and it will be understood by those having ordinary skill in the art that various changes in form and detail may be made without departing from the spirit and scope of the disclosure, including the appended claims.

What is claimed is:

1. A display apparatus comprising:

a display panel including a plurality of pixels and configured to display an image based on an image signal;

a backlight including a plurality of light sources, and configured to independently operate a light emitting block corresponding to each of the plurality of light sources to provide light to the display panel; and a processor configured to control an amount of light of each of the plurality of light sources based on the image signal, wherein the processor is configured to:

obtain an amount of a red (R) light, an amount of a green (G) light, and an amount of a blue (B) light that at least one light source among the plurality of light sources is configured to emit to one area on the display panel based on a distance between the at least one light source and the one area and a strength of the at least one light source, adjust an image signal corresponding to the one area based on each of the obtained amounts of the R light, the G light, and the B light.

2. The display apparatus of claim 1, wherein the processor is configured to:

identify color information of the one area based on a sum of an amount of a red (R) light, an amount of a green (G) light, and an amount of a blue (B) light that a first light source among the plurality of light sources is configured to emit to the one area and an amount of a red (R) light, an amount of a green (G) light, and an amount of a blue (B) light that a second light source among the plurality of light sources is configured to emit to the one area, adjust the image signal corresponding to the one area based on the color information.

3. The display apparatus of claim 1, wherein the processor is configured to:

identify color information based on conversion of each of the obtained amounts of the R light, the G light, and the B light to a color coordinate, adjust the image signal corresponding to the one area based the color information.

4. The display apparatus of claim 3, wherein the color information includes a color temperature.

5. The display apparatus of claim 1, wherein the one area includes an area corresponding to at least one light emitting block among the plurality of light emitting blocks or an area corresponding to at least one among the plurality of pixels of the display panel.

6. The display apparatus of claim 1, wherein the processor is configured to:

identify color information of the one area based on each of the obtained amounts of the R light, the G light, and the B light, and adjust a ratio among a red (R) signal, a green (G) signal, and a blue (B) signal of an image signal corresponding to the one area based on the identified color information.

7. The display apparatus of claim 6, wherein the processor is configured to:

based on a color temperature according to the identified color information being greater than or equal to a threshold temperature, adjust the ratio among the R signal, the G signal, and the B signal such that a strength of the B signal is relatively increased compared to a strength of the R signal and a strength of the G signal, and based on a color temperature according to the identified color information being less than a threshold temperature, adjust the ratio among the R signal, the G signal, and the B signal such that the strength of the B signal is relatively decreased compared to the strength of the R signal and the strength of the G signal.

8. The display apparatus of claim 6, further comprising:

a memory storing information on the ratio of the strength of R image signal, the strength of the G image signal and the strength of the B image signal for each color information, wherein the processor is configured to:

adjust the ratio among the R signal, the G signal, and the B signal of an image signal corresponding to the one area based on the information stored in the memory and the identified color information.

9. The display apparatus of claim 1, further comprising:

a memory including information on the amount of light of each of the R light, G light, and B light according to a distance between the at least one light source among the plurality of light sources and the display panel, wherein the processor is configured to:

calculate the amount of the red (R) light, the amount of the green (G) light, and the amount of the blue (B) light based on the distance between the at least one light source and the one area based on the information on the amount of light stored in the memory.

10. The display apparatus of claim 9, wherein the backlight further comprises a light sheet separately arranged in an upper part of the plurality of light sources, and the information on the amount of light includes information calculated based on a first amount of light emitted from the at least one light source that reaches an area of the light sheet and a second amount of light emitted from the at least one light source reflected on the light sheet that reaches an area of the light sheet.

11. The display apparatus of claim 9 wherein the backlight comprises a light sheet, and each of the plurality of light sources includes a blue LED, and the light sheet includes a quantum dot sheet.

12. A method of controlling a display apparatus comprising a backlight including a plurality of light sources, and configured to independently operate a light emitting block corresponding to each of the plurality of light sources to provide light to a display panel, the method comprising:

obtaining an amount of a red (R) light, an amount of a green (G) light, and an amount of a blue (B) light that at least one light source among the plurality of light sources is configured to emit to an area on the display panel based on a distance between the at least one light source and the area and a strength of the at least one light source;

and adjusting an image signal corresponding to the area based on each of the obtained amounts of the R light, the G light, and the B light.

13. The method of claim 12, further comprising:

identifying color information of the area based on the sum of an amount of a red (R) light, an amount of a green (G) light, and an amount of a blue (B) light that a first light source among the plurality of light sources emits to the area and an amount of a red (R) light, an amount of a green (G) light, and an amount of a blue (B) light that a second light source among the plurality of light sources emits to the area, and wherein the adjusting the image signal comprises adjusting the image signal corresponding to the area based on the color information.

14. The method of claim 12, further comprises:

identifying color information based on conversion of each of the calculated amounts of the R light, the G light, and the B light to a color coordinate, and wherein the adjusting the image signal comprises adjusting the image signal corresponding to the area based on the color information.

15. The method of claim 14, wherein the color information includes a color temperature.

16. The method of claim 12, wherein the area is an area corresponding to at least one light emitting block among the plurality of light emitting blocks or an area corresponding to at least one among the plurality of pixels of the display panel.

17. The method of claim 12, further comprising:

identifying color information of the area based on each of the obtained amounts of the R light, the G light, and the B light wherein the adjusting an image signal comprises:

adjusting a ratio among a red (R) signal, a green (G) signal, and a blue (B) signal of an image signal corresponding to the area based on the identified color information.

18. The method of claim 17, wherein the adjusting an image signal comprises:

based on a color temperature according to the identified color information being greater than or equal to a threshold temperature, adjusting the ratio among the R signal, the G signal, and the B signal such that the strength of the B signal is relatively increased compared to the strength of the R signal and the strength of the G signal; and based on a color temperature according to the identified color information being less than a threshold temperature, adjusting the ratio among the R signal, the G signal, and the B signal such that the strength of the B signal is relatively decreased compared to the strength of the R signal and the strength of the G signal.

19. The method of claim 17, wherein the adjusting an image signal comprises:

reading the ratio of the strength of RGB image signals corresponding to the identified color information from a memory storing information on the ratio of the strength of R image signal, the strength of the G image signal and the strength of the B image signal for each color information and adjusting the ratio among the R signal, the G signal, and the B signal of an image signal corresponding to the area.

* * * * *